United States Patent [19]

Bar-on

[11] 3,955,916

[45] May 11, 1976

[54] FUSER ROLL SHEET STRIPPING APPARATUS

[75] Inventor: Ari Bar-on, Rochester, N.Y.

[73] Assignee: Xerox Corporation, Stamford, Conn.

[22] Filed: Jan. 13, 1975

[21] Appl. No.: 540,640

[52] U.S. Cl. ..... 432/60; 271/DIG. 2; 271/174

[51] Int. Cl.[2] ..... B65H 29/54

[58] Field of Search ..... 271/DIG. 2, 80, 174, 271/172; 432/60; 118/245; 355/3 R

[56] References Cited

UNITED STATES PATENTS

| | | | |
|---|---|---|---|
| 2,659,340 | 11/1953 | Zinn, Jr. | 118/245 |
| 2,731,263 | 1/1956 | Baril, Jr. et al. | 271/172 |
| 3,614,095 | 10/1971 | Beck et al. | 271/80 |
| 3,881,859 | 5/1975 | Hamilton | 271/DIG. 2 |

*Primary Examiner*—John J. Love
*Assistant Examiner*—Robert Saifer
*Attorney, Agent, or Firm*—H. Fleischer; J. J. Ralabate; C. A. Green

[57] ABSTRACT

An apparatus in which a sheet of support material having particles substantially permanently affixed thereto is separated from a heated fuser member. The heated fuser member is operatively associated with a back up member such that the sheet of support material passes therebetween. As the sheet of support material passes therebetween, the particles thereon contact the fuser member. In this manner, the particles are thermally fused to the sheet of support material. Thereafter the sheet of support material with the particles affixed thereto is separated from the fuser member.

10 Claims, 5 Drawing Figures

FUSER ROLL SHEET STRIPPING APPARATUS

The foregoing abstract is neither intended to define the invention disclosed in the specification, nor is it intended to be limiting as to the scope of the invention in any way.

BACKGROUND OF THE INVENTION

This invention relates to an electrostatographic printing machine, and more particularly concerns an apparatus for separating a sheet of support material from a heated fuser member employed in the printing machine.

In a typical electrostatographic printing machine, a latent image is recorded on a surface and developed with charged particles. After the latent image is developed, a sheet of support material is positioned closely adjacent thereto so as to receive the particles therefrom. The particles are then permanently affixed to the sheet of support material forming a copy of the original document thereon. Electrographic and electrophotographic printing are differing versions of electrostatographic printing. The process of electrophotographic printing employs a photoconductive member arranged to be charged to a substantially uniform level. The charged photoconductive member is exposed to a light image of an original document. The light image irradiates the charged photoconductive member dissipating the charge in accordance with the intensity of the light transmitted thereto. This records an electrostatic latent image on the photoconductive surface. Electrographic printing differs from electrophotographic printing in that neither a photoconductive member nor a light image of the original document are required to create a latent image on the surface. Both of the foregoing processes generally employ heat settable particles to develop the latent image. The particles are permanently fused to the sheet of support material by the application of heat thereto.

Various techniques have been developed for applying heat to the particles on the sheet of support material. One technique is to pass the sheet of support material with the powder image thereon through a pair of opposed rollers. In one such system, a heated fuser roll and a non-heated back up roll are employed. Preferably, the heated fuser roll has the outer surface thereof covered with a polytetrofluoroethylene commonly known as Teflon to which a release agent such as a silicone oil is applied. The Teflon layer, preferably, has a thickness of about several mils. An alternate approach has been to employ a bare metal heated roll which has a low molecular weight polyethylene applied thereto as a release agent. When heated rolls of this type are employed, the sheet of support material with the toner powder image thereon frequently tends to adhere thereto.

Hereinbefore, various techniques have been devised to strip or separate the sheet of support material from the heated fuser member. One such technique is the utilization of stripper fingers. However, stripper fingers frequently mar the fused toner image adhering to the sheet of support material. Other approaches frequently result in the sheet of support material tending to curl or roll up rather than remaining flat.

Accordingly, it is the primary object of the present invention to improve the apparatus employed to separate the sheet of support material from the fuser member.

SUMMARY OF THE INVENTION

Briefly stated, and in accordance with the present invention, there is provided an apparatus for separating a sheet of support material from a heated fuser member. The fuser member is operatively associated with a back up member and the sheet of support material passes therebetween. As the sheet of support material pases therebetween, particles thereon contact the heated fuser member.

Pursuant to the features of the present invention, the apparatus includes a blade member and resilient means. The resilient means urges the leading edge portion of the blade member into contact with the fuser member. In this manner, the blade member is interposed between the fuser member and the sheet of support material separating the sheet of support material therefrom.

BRIEF DESCRIPTION OF THE DRAWINGS

Other objects and advantages of the present invention will become apparent upon reading the following detailed description and upon reference to the drawings, in which.

While the present invention will hereinafter be described in connection with various preferred embodiments thereof, it will be understood that it is not intended to limit the invention to those embodiments. On the contrary, it is intended to cover all alternatives, modifications and equivalents as may be included within the spirit and scope of the invention as defined by the appended claims.

DETAILED DESCRIPTION OF THE INVENTION

Figure 1:
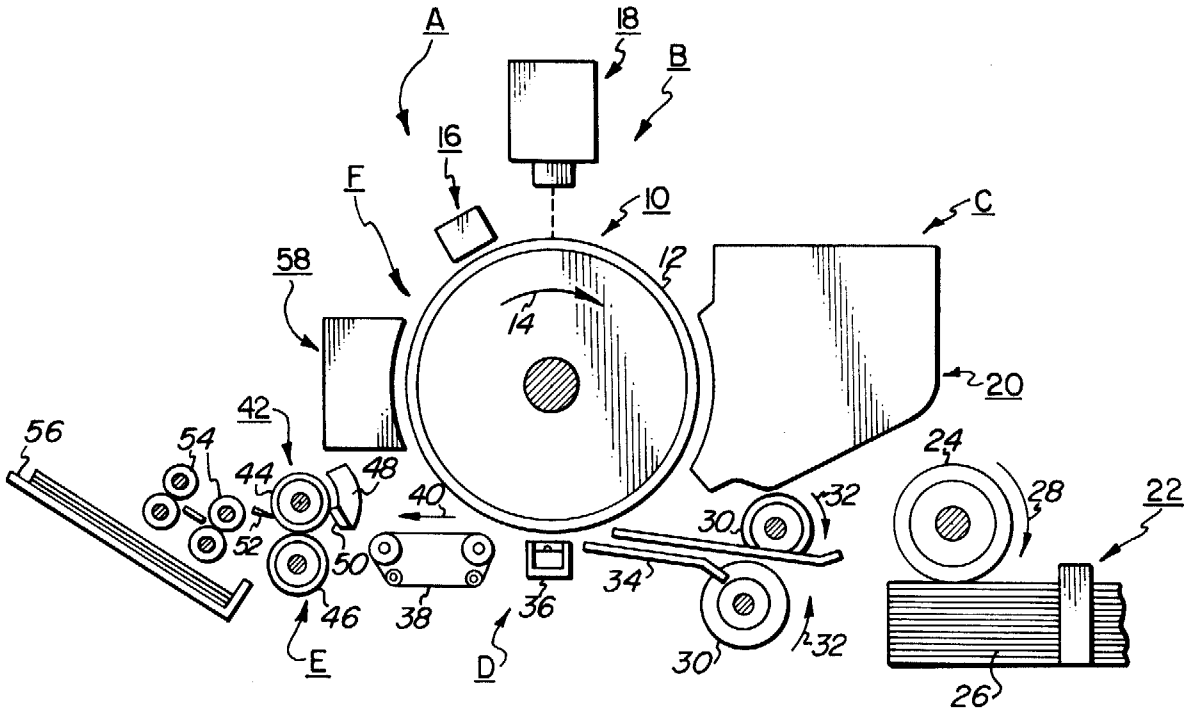
FIG. 1 is a schematic elevational view of an electrophotographic printing machine incorporating the features of the present invention therein.

For a general understanding of an electrophotographic printing machine incorporating features of the present invention therein, reference is had to FIG. 1 which depicts schematically the various components thereof. Hereinafter, like reference numerals shall be employed throughout to designate like elements. Although the apparatus for separating the sheet of support material from a fuser member employed in the electrophotographic printing machine of FIG. 1, is particularly well adapted for use therein, it should become evident from the following discussion that it is equally well suited for use in a wide variety of devices, and is not necessarily limited in its application to the particular embodiment shown herein.

Since the practice of electrophotographic printing is well known in the art, the various processing stations for producing a copy of an original document are herein represented schematically in FIG. 1 by the reference letters A through E, inclusive.

Referring now to FIG. 1, the electrophotographic printing machine has a drum 10 with a photoconductive surface 12 entrained about and secured to the exterior circumferential surface thereof. Drum 10 rotates in the direction of arrow 14 to pass through the various processing stations disposed about the periphery thereof. A suitable photoconductive material is generally made from a selenium alloy such as is described in U.S. Pat. No. 2,970,906 issued to Bixby in 1961.

Drum 10 initially rotates a portion of photoconductive surface 12 through charging station A. Charging station A employs a corona generating device, indicated generally at 16, to sensitize the portion of photoconductive surface 12 passing therebeneath. As shown in FIG. 1, corona generating device 16 is positioned closely adjacent to photoconductive surface 12. Energization of corona generating device 16 charges photoconductive surface 12 to a relatively high substantially uniform potential. One type of suitable corona generating device 16 may be of the type described in U.S. Pat. No. 2,836,725 issued to Vyverberg in 1958.

After a portion of photoconductive surface 12 has been charged to a suitable level, drum 10 rotates the charge portion thereof to exposure station B. Exposure station B includes an exposure mechanism, indicated generally by the reference numeral 18, having a transparent platen such as a glass plate amongst others, arranged to support an original document thereon. Lamps, positioned beneath the transparent platen, illuminate the original document disposed thereon. The original document may be scanned by an oscillating mirror which moves in a timed relationship with the rotation of drum 10. The mirror is positioned beneath the platen to reflect the light rays reflected from the original document through a lens forming a light image thereof. The light image passing through the lens is transmitted to a mirror, which, in turn, reflects it through an aperture slit onto the charged portion of photoconductive surface 12. As the light image irradiates the charged portion of photoconductive surface 12, the charge thereon is dissipated in accordance with the light intensity recording thereon an electrostatic latent image corresponding to the original document.

After the electrostatic latent image is recorded on photoconductive surface 12, drum 10 rotates it to development station C. Development station C includes a developer unit 20 having a housing with a supply of developer mix therein. The developer mix comprises carrier granules with toner particles adhering thereto. The carrier granules are formed from a magnetic material with the toner particles being a heat settable thermoplastic material. Preferably, developer unit 20 is a magnetic brush development system. In such a system, the developer mix is brought through a directional flux field to form a brush thereof. The brush of developer mix is brought into contact with the electrostatic latent image. The electrostatic latent image attracts the toner particles from the carrier granules producing a toner powder image onn photoconductive surface 12.

Prior to proceeding with the remaining processing stations, the sheet feeding operation will be briefly described. The sheet feeding apparatus, indicated generally by the reference numeral 22, includes a feed roll 24 contacting the uppermost sheet of a stack 26 of sheets of support material. Feed roll 24 rotates in the direction of arrow 28 to thereby advance the uppermost sheet from stack 26. As the sheet advances, it is interposed between registration rolls 30. Registration rolls 30 rotate in the direction of arrow 32 to align and forward the advancing sheet of support material into chute 34. Chute 34 directs the advancing sheet of support material into contact with photoconductive surface 12 at transfer station D. The sheet of support material contacts photoconductive surface 12 in registration with the toner powder image deposited thereon.

At transfer station D, corona generating device 36 applies a spray of ions to the side of the sheet of support material opposed from photoconductive surface 12. In this manner, the toner powder image is attracted from photoconductive surface 12 to the sheet of support material. After the toner powder image has been transferred to the sheet of support material, endless belt conveyor 38 advances the sheet of support material, in the direction of arrow 40, to fusing station E.

At fusing station E, a fusing apparatus, indicated generally by the reference numeral 42, permanently affixes the toner powder image to the sheet of support material. Fusing apparatus 42 includes a heated fuser roll 44 operatively associated with back up roll 46. Dispenser 48 is adapted to apply release material to fuser roll 44. Metering blade 50 regulates the thickness of the layer of release material applied to fuser roll 44. The release material insures that the toner powder image does not stick to the fuser roll 44. After the toner powder image has been permanently affixed to the sheet of support material, sheet stripping apparatus 52 separates the sheet of support material therefrom. Stripping apparatus 52 will be described hereinafter in greater detail with reference to FIGS. 2 through 5, inclusive. The sheet of support material is then advanced by a series of rolls 54 to catch tray 56 for subsequent removal therefrom by the machine operator.

Invariable, after the sheet of support material is separated from photoconductive surface 12, residual toner particles adhere thereto. These residual toner particles are removed from photoconductive surface 12 at cleaning station F. Cleaning station F includes a cleaning apparatus indicated generally by the reference numeral 58. Cleaning apparatus 58 includes a corona generating device and a brush. The corona generating device neutralizes the remaining electrostatic charge on photoconductive surface 12 and that of the residual toner particles. After the charge on both photoconductive surface 12 and the toner particles is neutralized, the brush contacting photoconductive surface 12 rotates to remove the toner particles therefrom. Subsequent to cleaning, a discharge lamp floods photoconductive surface 12 with light to dissipate any residual electrostatic charge remaining thereon. This insures that photoconductive surface 12 is returned to its initial charge level prior to being charged for the next successive imaging cycle.

It is believed that the foregoing description is sufficient for purposes of the present application to illustrate the general operation of an electrophotographic printing machine. Referring now to the specific subject matter of the present, FIGS. 2 and 3 depict one embodiment of sheet separating apparatus 52, whereas FIGS. 4 and 5 depict another embodiment thereof.

With continued reference to FIG. 1, back up roll 46 is mounted rotatably on a pair of brackets secured to a channel shaped base in the electrophotographic printing machine. Preferably, back up roll 46 includes a rigid steel core or shaft having a Viton elastomeric surface or layer disposed thereover and affixed thereto. The shaft is secured rotatably on brackets by a pair of bearings held in place by retaining rings. By way of example, the back up roll has an overall dimension of approximately 1.55 inches with a 0.1 inch cover or layer of Viton or other suitable high temperature elastomeric material, for example fluorosilicone or silicone rubber. Fuser roll 44 cooperates with back up roll 46 to form a nip therebetween through which a sheet of support material having a toner powder image thereon passes.

Figure 2:
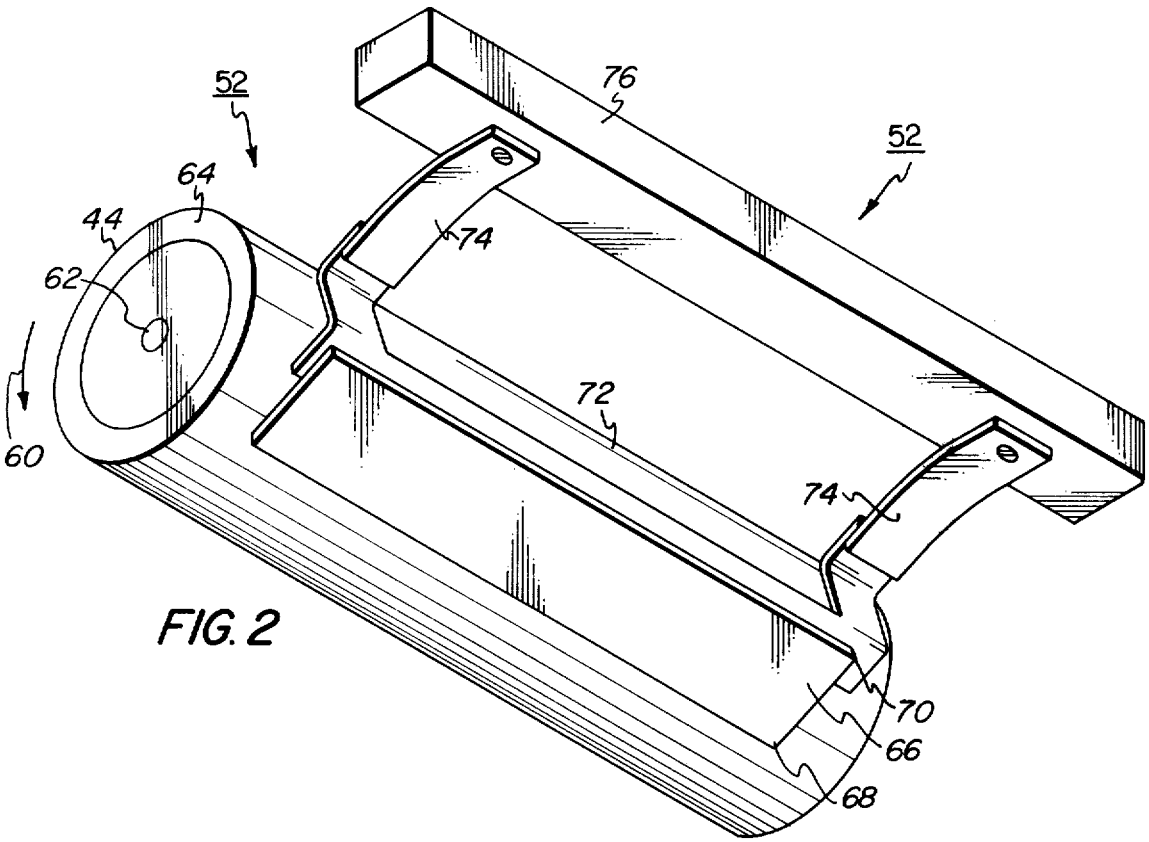
FIG. 2 is a schematic perspective view of one embodiment of a sheet separating apparatus associated with the FIG. 1 printing machine fuser roll.
Figure 4:
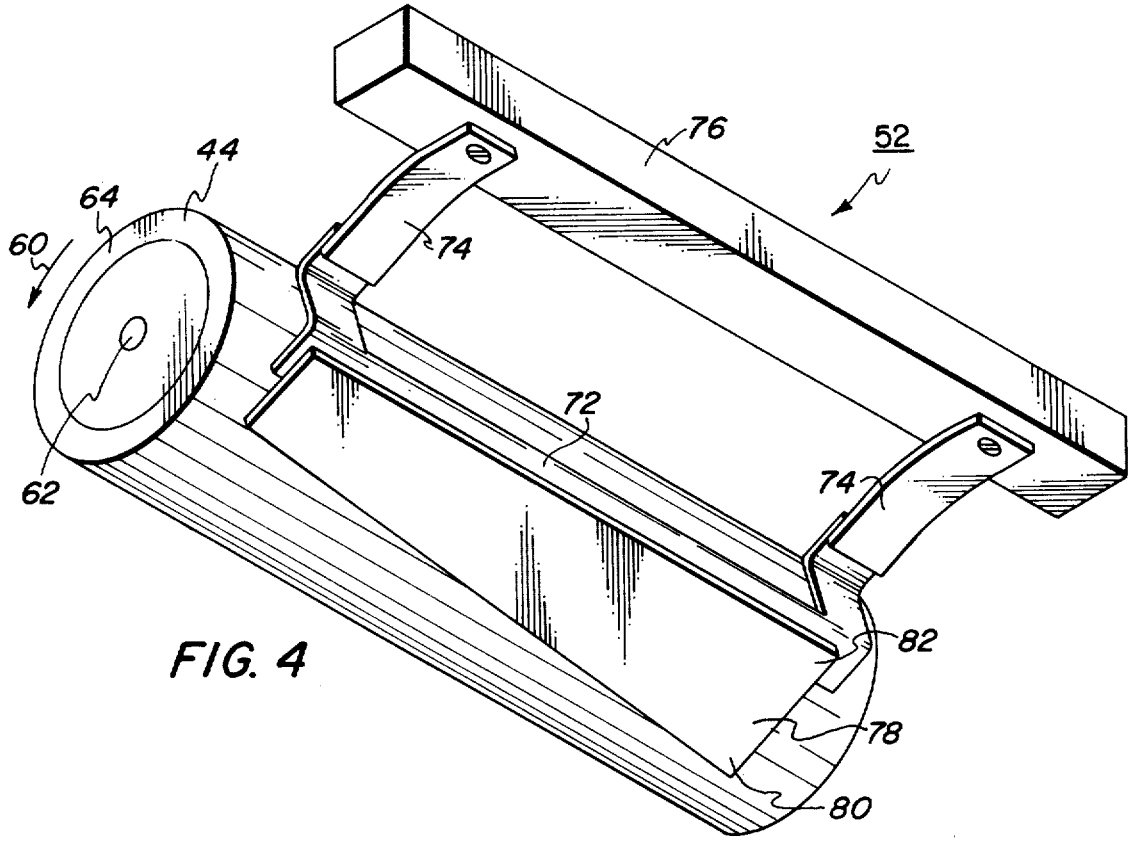
FIG. 4 is a schematic perspective view of another embodiment of the sheet separating apparatus associated with the FIG. 1 printing machine fuser roll.
Figure 5:
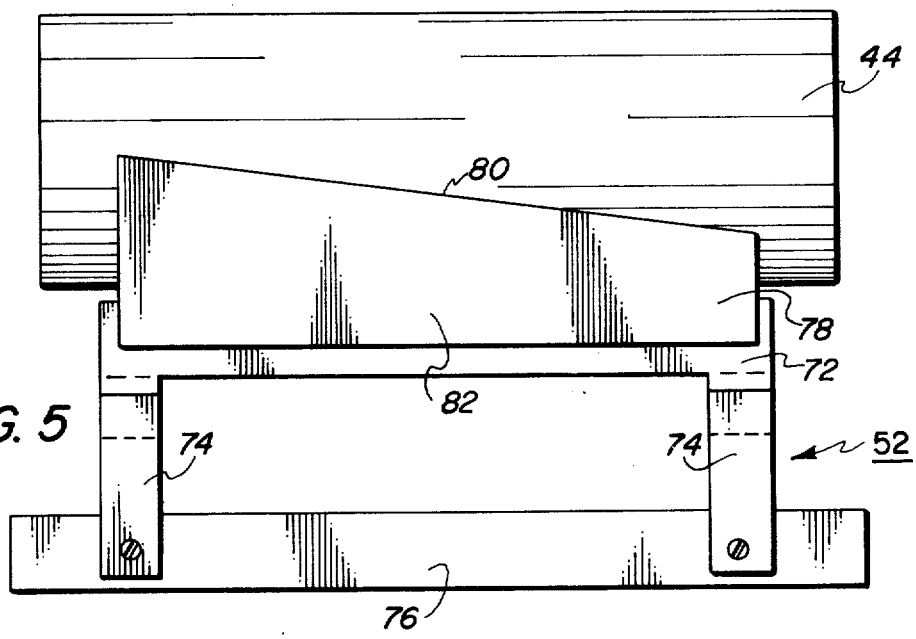
FIG. 5 is a schematic plan view of the FIG. 4 sheet separating apparatus.

Referring now to FIGS. 2 and 4, fuser roll 44 is shown therein, in greater detail, associated with each embodiment of sheet stripping apparatus 52. Fuser roll 44 is mounted rotatably on a pair of brackets having a generally E-shaped configuration. A pair of ball bearings, one in each support bracket, secure fuser roll 44 rotatably thereon. The bearings are retained in the brackets by means of retaining rings. A pair of end caps are secured to a hollow cylinder or core 64 forming a part of fuser roll 44. The end caps have reduced end portions so as to be mounted in the bearings permitting fuser roll 44 to rotate in the direction of arrow 60. Heating element 62 is supported internally of core 64 for providing thermal energy to heat core 64 to the operating temperature thereof. Heating element 62 may comprise any suitable type of heater for elevating the surface temperature of core 64 to operational temperature, i.e., 285° to 295°F. By way of example, heating element 62 may include a quartz envelope having a constant resistance heating element disposed therein. Preferably, cylinder 64 is fabricated from any suitable material capable of efficiently conducting heat to the external surface thereof. For example, suitable materials are anodized aluminum and alloys thereof, steel, stainless steel, nickel and alloys thereof, nickel plated copper, chromium plated copper, and copper and alloys thereof. The resultant fuser roll 44 has an outside diameter preferably about 1.5 inches with the length thereof about equal to that of back up roll 46, i.e., preferably about 15½ inches long. In operation, fuser roll 44 requires about 420 watts peak power with the average power being about 320 watts and about 100 watts being provided for standby operation. The toner powder image on the sheet of support material contacts fuser roll 44. As the sheet of support material passes through the nip, sheet separating apparatus 52 strips the sheet of support material from fuser roll 44.

Figure 3:
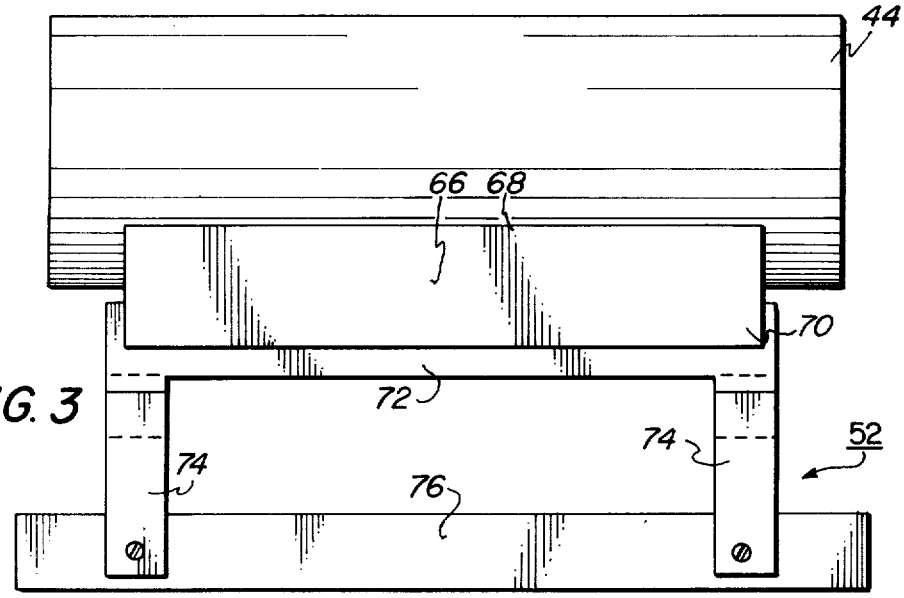
FIG. 3 is a schematic plan view of the FIG. 2 sheet separating apparatus.

FIGS. 2 and 3 depict one embodiment of sheet separating apparatus 52. As shown therein, sheet separating apparatus 52 includes a blade member 66 having the leading marginal edge portion 68 thereof contacting fuser roll 44. The trailing marginal edge 70 of blade member 66 is secured to a Z-shaped bracket 72. A pair of opposed spaced leaf springs 74 have the leading marginal portion thereof secured to Z-shaped bracket 72. The trailing marginal portion of leaf springs 74 are secured to a support member 76 integral with the electrophotographic printing machine. As shown in FIG. 3, leading marginal edge 68 of blade member 66 extends in a direction substantially normal to the path of movement of the sheet of support material. It should be noted that blade member 66 is a substantially rectangular member preferably made from a thin sheet of stainless steel. Leaf spring 74 is also preferably made from spring steel. Similarly, bracket 72 may be made from any suitable steel.

Turning now to FIGS. 4 and 5 an alternate embodiment of sheet stripping apparatus 52 will be described with reference thereto. As shown in FIGS. 4 and 5, blade member 78 has leading marginal edge portion 80 contacting fuser roll 44. The trailing marginal edge portion 82 of blade member 78 is secured to Z-shaped bracket 72. Once again, Z-shaped bracket 72 is secured to two opposed, spaced leaf springs 74. The trailing edge of leaf spring 74 is attached to support integral with the electrophotographic printing machine. The leading marginal edge 80 of blade member 78 extends in a non-perpendicular direction relative to the path of movement of the sheet of support material. Preferably, blade member 78, as shown in FIG. 5, is a trapezoidal member formed from a thin sheet of stainless In recapitulation, the sheet stripping apparatus of the present invention is adapted to separate a sheet of support material having a toner powder image permanently affixed thereto from a heated fuser member. The sheet stripping apparatus accomplishes the foregoing without curling the sheet of support material or marring the toner powder image adhering thereto.

It is, therefore, evident that there has been provided, in accordance with the present invention, an apparatus for stripping a sheet of support material from a heated fuser member employed in an electrophotographic printing machine. The apparatus of the present invention fully satisfies the objects, aims and advantages hereinbefore set forth. While this invention has been described in conjunction with specific embodiments thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An apparatus for separating a moving sheet of support material having particles thereon from a heated fuser member operatively associated with a back up member wherein the sheet of support material passes therebetween with the particles thereon contacting the fuser member, including:

a blade member;

a support member;

a leaf spring having the trailing marginal edge portion thereof secured to said support member; and a Z-shaped bracket having the trailing marginal edge portion thereof secured to the leading marginal edge portion of said leaf spring, said Z-shaped bracket having the leading marginal edge portion thereof secured to the trailing marginal edge portion of said blade member.

2. An apparatus as recited in claim 1, wherein the leading marginal edge portion of said blade member contacts the fuser member and extends in a direction substantially normal to the path of movement of the sheet of support material.

3. An apparatus as recited in claim 2, wherein said blade member includes a substantially rectangular member.

4. An apparatus as recited in claim 1, wherein the leading marginal edge portion of said blade member contacts the fuser member and extends in a substantially non-perpendicular direction to the path of movement of the sheet of support material.

5. An apparatus as recited in claim 4, wherein said blade member includes a substantially trapezoidal member.

6. A fusing apparatus employed in an electrostatographic printing machine for permanently affixing toner particles on a moving sheet of support material thereto, including:

a heated fuser roll;

a back up roll operatively associated with said fuser roll to enable the sheet of support material to pass therebetween with the toner particles contacting said fuser roll;

a blade member;

a support member;

a leaf spring having the trailing marginal edge portion thereof secured to said support member; and a Z-shaped bracket having the trailing marginal edge portion thereof secured to the leading marginal edge portion of said leaf spring, said Z-shaped bracket having the trailing marginal edge portion thereof secured to the trailing marginal edge portion of said blade member.

7. An apparatus as recited in claim 6, wherein the leading marginal edge portion of said blade member contacts said fuser roll and extends in a direction substantially normal to the path of movement of the sheet of support material.

8. An apparatus as recited in claim 7, wherein said blade member includes a substantially rectangular member.

9. An apparatus as recited in claim 6, wherein the leading marginal edge portion of said blade member contacts said fuser roll and extends in a substantially non-perpendicular direction to the path of movement of the sheet of support material.

10. An apparatus as recited in claim 9, wherein said blade member includes a substantially trapezoidal member.

* * * * *